US007168890B1

(12) United States Patent
Evarts

(10) Patent No.: US 7,168,890 B1
(45) Date of Patent: Jan. 30, 2007

(54) ECCENTRIC VIBRATION SYSTEM WITH RESONANCE CONTROL

(75) Inventor: Kingsley S. Evarts, Pittsburg, PA (US)

(73) Assignee: American Piledriving Equipment, Inc., Kent, WA (US)

( * ) Notice: Subject to any disclaimer, the term of this patent is extended or adjusted under 35 U.S.C. 154(b) by 10 days.

(21) Appl. No.: 11/039,486

(22) Filed: Jan. 19, 2005

Related U.S. Application Data

(60) Provisional application No. 60/537,586, filed on Jan. 20, 2004.

(51) Int. Cl.
*E02D 7/18* (2006.01)

(52) U.S. Cl. ..... 405/232; 173/49

(58) Field of Classification Search ..... 405/232; 173/49

See application file for complete search history.

(56) References Cited

U.S. PATENT DOCUMENTS 5,253,542 A * 10/1993 Houze ..... 74/61
RE34,460 E * 11/1993 Ishiguro et al. ..... 270/58.15
5,410,879 A * 5/1995 Houze ..... 60/469
6,039,508 A * 3/2000 White ..... 405/232
6,431,795 B2 * 8/2002 White ..... 405/232
6,543,966 B2 * 4/2003 White ..... 405/232

* cited by examiner

*Primary Examiner*—Frederick L. Lagman
(74) *Attorney, Agent, or Firm*—Michael R. Schacht; Schacht Law Office, Inc.

(57) ABSTRACT

The present invention may be embodied as an eccentric vibration system comprising a major eccentric member, a minor eccentric member, first and second motor assemblies, and a transmission system. The transmission system operates in a first mode when a torque of the first motor assembly is less than a torque of the second motor assembly and in a second mode when the torque of the first motor assembly is greater than the torque of the second motor assembly. When the transmission system operates in the first mode, longitudinal vibratory forces generated by the major eccentric member substantially cancel longitudinal vibratory forces generated by the minor eccentric member. When the transmission system operates in the second mode, longitudinal vibratory forces generated by the major eccentric member are added to longitudinal vibratory forces generated by the minor eccentric member.

35 Claims, 4 Drawing Sheets

22
72
76
82
50b
54b
104
102
62b
26b
88
90b
94
$A_{JPb}$, $A_{NDb}$
100
96b
64b
60b
52b
92b
$A_{JDb}$, $A_{NPb}$
24b
$A_{LS}$
24a
98b
60a
$A_{JDa}$, $A_{NPa}$
52a
64a
98a
62a
50a
90a
$A_{JPa}$, $A_{NDa}$
54a
96a
26a
70
80
84
86
74
$A_{T1}$
$A_{T2}$
$A_{TM}$
20
3
4

32
2
82
72
76
34
$A_{JPb}$, $A_{NDb}$
54b
104
102
26b
$A_{JDb}$, $A_{NPb}$
64b
100
24b
$A_{JDa}$, $A_{NPa}$
24a
$A_{JPa}$, $A_{NDa}$
64a
26a
54a
74
70
80
20
30

ECCENTRIC VIBRATION SYSTEM WITH RESONANCE CONTROL

RELATED APPLICATIONS

This application claims priority of U.S. Provisional Application Ser. No. 60/537,586 filed on Jan. 20, 2004.

TECHNICAL FIELD

The present invention relates to vibration systems and methods for driving elongate members into the earth and, more specifically, to vibration systems that use counter-rotating eccentric weights to generate vibratory forces.

BACKGROUND OF THE INVENTION

Counter-rotating pairs of eccentric weights are often used to generate vibratory forces for driving elongate members such as piles, caissons, and the like. As is well-known in the art, when eccentric weights are rotated in-phase in opposite directions at the same speed, the transverse force components of each pair of eccentric weights cancel each other, while the longitudinal force components of each pair of eccentric weights are summed together.

Problems may arise when the counter-rotating weights are accelerated and/or decelerated. In particular, the counter-rotating weights are typically used as part of a larger driving system including a vibro housing, a clamp assembly, a suppression assembly, and a support assembly. The counter-rotating weights are mounted within the vibro housing. The vibro housing is secured to the clamp assembly and the suppression assembly. The clamp assembly rigidly secures the vibro housing to the elongate member to be drive, while the suppression assembly inhibits transmission of the vibratory forces from the vibro housing to the support assembly.

The longitudinal vibratory forces have a frequency determined by the rotational speed of the eccentric members. As the counter-rotating weights are accelerated and decelerated, the frequency of longitudinal vibratory forces may move through a range of frequencies that may cause other components of the driving system to resonate. When the driving system or portions thereof resonates, the driving system and the elongate member connected thereto can become unstable and/or become damaged. Ideally, resonant vibration upon starting and stopping of the driving system should be avoided.

The Applicant is aware of a class of eccentric vibration systems that may be used in a manner that avoids resonant vibration during starting and stopping. In particular, variable moment eccentric vibration systems allow the operator to vary the moment of the vibration system during operation. Variable moment eccentric vibration systems can be operated such that resonant frequencies during starting and stopping are avoided.

Variable moment eccentric vibration systems are, however, expensive and complex and require significantly more maintenance than conventional eccentric vibration systems. The need thus exists for eccentric vibration systems that avoid resonant frequencies during starting and stopping but are inexpensive and simple to operate and maintain.

SUMMARY OF THE INVENTION

The present invention may be embodied as an eccentric vibration system comprising a major eccentric member, a minor eccentric member, first and second motor assemblies, and a transmission system. The transmission system connects the first and second motor assemblies to the major and minor eccentric members and operates in a first mode when a torque of the first motor assembly is less than a torque of the second motor assembly and a second mode when the torque of the first motor assembly is greater than the torque of the second motor assembly.

When the transmission system operates in the first and second modes, the first and second motor assemblies rotate the major and minor eccentric members through the transmission system such that transverse vibratory forces generated by the major eccentric member substantially cancel transverse vibratory forces generated by the minor eccentric member.

When the transmission system operates in the first mode, the first and second motor assemblies rotate the major and minor eccentric members through the transmission system such that longitudinal vibratory forces generated by the major eccentric member substantially cancel longitudinal vibratory forces generated by the minor eccentric member.

When the transmission system operates in the second mode, the first and second motor assemblies rotate the major and minor eccentric members through the transmission system such that longitudinal vibratory forces generated by the major eccentric member are added to longitudinal vibratory forces generated by the minor eccentric member.

BRIEF DESCRIPTION OF THE DRAWINGS

FIG. 3 is a section view taken along lines 3—3 in FIG. 2;

DETAILED DESCRIPTION OF THE INVENTION

Figure 1:
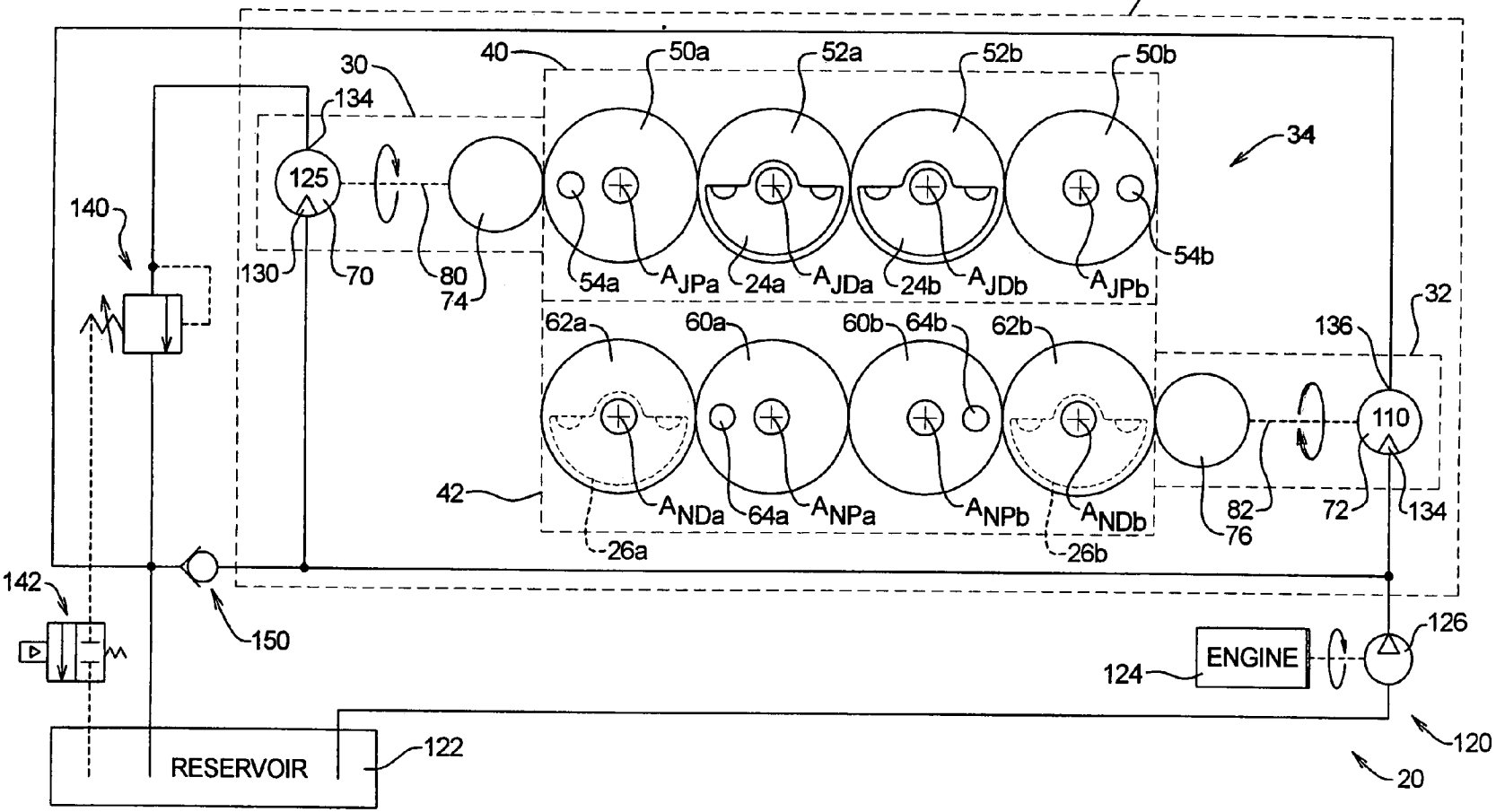
FIG. 1 is a highly schematic block diagram view of an eccentric vibration system of the present invention.
Figure 2:
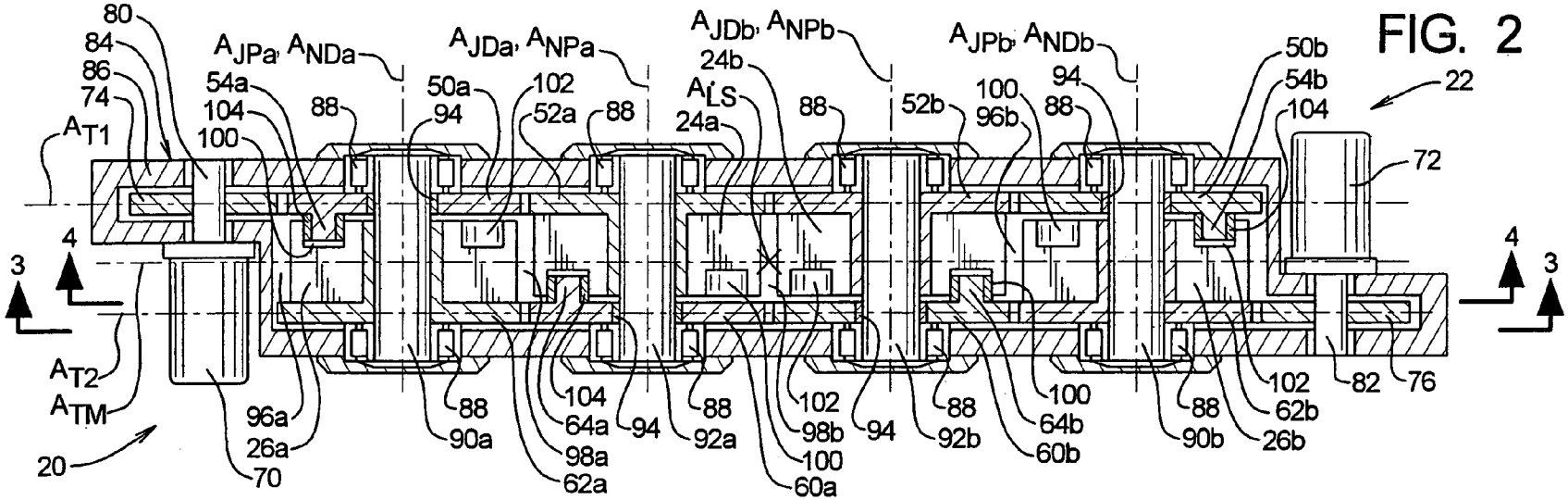
FIG. 2 is a top plan section view illustrating an eccentric vibration device of the system of FIG. 1 taken along lines 2—2 in FIG. 3.
Figure 3:
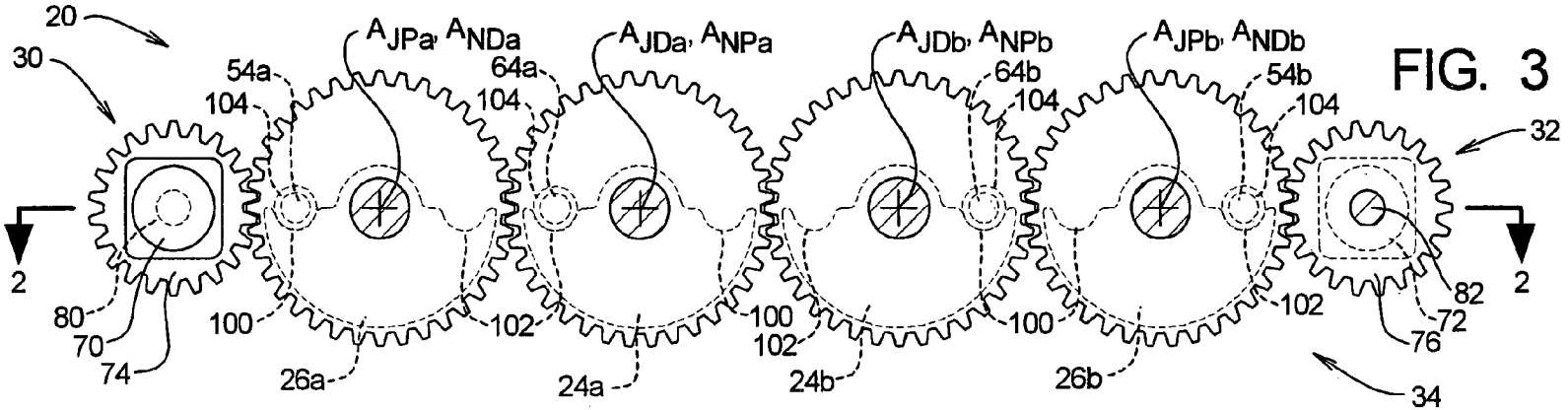
FIG. 3 is a side elevation view of the eccentric vibration device of FIG. 2.

Referring initially to FIG. 1 of the drawing, depicted therein is a block diagram of an example eccentric vibration system 20 constructed in accordance with, and embodying, the principles of the present invention. As shown in FIGS. 1–3, the eccentric vibration system 20 includes a vibration device 22 comprising at least one major eccentric member 24 and at least one minor eccentric member 26. The eccentric members 24 and 26 are driven by first and second motor assemblies 30 and 32 through a transmission system 34.

The transmission system 34 operates in a first mode or a second mode depending on the relative torques applied to the transmission system 34 by the motor assemblies 30 and 32. In particular, when a torque of the first motor assembly 30 is less than the torque of the second motor assembly 32, the transmission assembly operates in the first mode. The transmission assembly operates in the second mode when a torque of the first motor assembly 30 is greater than the torque of the second motor assembly 32.

As is well-known in the art, vibratory forces can be generated by rotating eccentric members with parallel axes of rotation in phase and at the same speed but in opposite directions. As will be described in further detail below, the term "in-phase" as used herein indicates that the centers of gravity of two eccentric members are at all times substantially symmetrically located about a plane of symmetry parallel to and spaced equidistant from the axes about which the eccentric members rotate. The term "counter-rotate" as used herein indicates that eccentric members are rotated at the same speed in opposite directions.

When eccentric members are counter-rotated in-phase about parallel axes, transverse vibratory forces cancel each other and the longitudinal vibratory forces are summed. The result is back and forth movement along a longitudinal system axis and little or no transverse or horizontal movement along an transverse system axis orthogonal to the longitudinal system axis.

In the example eccentric vibration system 20, the transmission system 34 is configured such that, in the second mode, the major and minor eccentric members 24 and 26 are conventionally counter-rotated in-phase. The vibration device 22 thus generates longitudinal vibratory forces along a system longitudinal axis $A_{LS}$ and little or no transverse vibratory forces along a main transverse axis $A_{TM}$ when the transmission system 34 operates in the second mode. As will be described in further detail below, this movement of the eccentric vibration device 22 forms a vibratory force that may be used to drive piles and other elongate members into the earth.

However, in the first mode, the transmission system 34 is configured such that the major and minor eccentric members 24 and 26 are counter-rotated but are approximately 180 degrees out of phase with each other. The result is that both longitudinal and transverse forces are cancelled. Accordingly, in the first mode, the eccentric vibration device 22 does not move or vibrate along either the longitudinal or transverse axes $A_{LS}$ and $A_{TM}$.

The transmission system 34 is selectively placed in either the first mode or the second mode by altering the relative torques of the first and second motor assemblies 30 and 32. In particular, the transmission system 34 operates in the first mode when a torque of the first motor assembly 30 is less than a torque of the second motor assembly 32. The transmission system 34 operates in the second mode when the torque of the first motor assembly 30 is greater than the torque of the second motor assembly 32.

In use, the relative torques of the first and second motor assemblies 30 and 32 are set such that the transmission system 34 is in the first mode during system start-up and system shut-down. The term "system start-up" refers to the acceleration of the eccentric members 24 and 26 from zero revolutions per minute to a predetermined desired operating speed. The term "system shut-down" refers to the deceleration of the eccentric members 24 and 26 from the predetermined desired operating speed back to zero revolutions per minute. Because the eccentric vibration device 22 does not vibrate when the transmission system 34 is in the first mode, the system 20 is unlikely to cause resonant vibration of components attached thereto during system start-up and system-shut down.

However, once the eccentric members 24 and 26 reach the predetermined desired operating speed, the relative torques of the first and second motor assemblies 30 and 32 are set such that the transmission system 34 operates in the second mode. The term "system operation" will refer to the continuous operation of the eccentric vibration system 20 at the desired operating speed with the transmission assembly 34 in the second mode.

During system operation, the eccentric vibration device 22 vibrates along the longitudinal axis $A_{LS}$ defined by the device 22. The desired operating speed is predetermined such that, when the eccentric vibration device 22 vibrates at a frequency associated with the desired operating speed, resonant vibration of components attached to the device 22 does not occur.

Accordingly, by altering the relative torques of the first and second motors and appropriately selecting the desired operating speed, the eccentric vibration system 20 may be operated to avoid resonant vibration of components attached thereto during system start-up, system operation, and system shut-down.

Given the foregoing general understanding of the present invention, the details of construction and operation of the example vibration system 20 will now be described in further detail.

Referring again to FIG. 1, it can be seen that the example transmission system 34 comprises a first transmission assembly 40 and a second transmission assembly 42. The first transmission assembly 40 is operatively connected to the first motor assembly 30 and to the major eccentric member 24. The second transmission assembly 42 is operatively connected to the second motor assembly 32 and to the minor eccentric member 26.

The first transmission assembly 40 comprises a major pin gear 50, a major direct gear 52, and a major drive pin 54. Axes $A_{JP}$ and $A_{JD}$ defined by the major pin gear 50 and major direct gear 52, respectively, are aligned along a first transverse axis $A_{T1}$ defined by the first transmission assembly 40. The second transmission assembly 42 similarly comprises a minor pin gear 60, a minor direct gear 62, and a minor drive pin 64. Axes $A_{NP}$ and $A_{ND}$ defined by the minor pin gear 60 and minor direct gear 62, respectively, are also aligned along a second transverse axis $A_{T2}$ defined by the second transmission assembly 40.

As will be described in further detail below, a plurality of major and minor eccentric members 24 and 26 may be used. Subscripted letters will be used in conjunction with reference characters herein to refer to components that are replicated when more than one major eccentric member 24 and more than one minor eccentric member 26 are used.

In the example eccentric vibration device 22 illustrated in FIGS. 1–3, first and second major eccentric members 24*a* and 24*b* and first and second minor eccentric members 26*a* and 26*b* are used. An eccentric vibration device of the present invention may also be constructed with a single major eccentric member and a single minor eccentric member. In addition, more than two major eccentric members and more than two minor eccentric members may be used in accordance with the principles of the present invention.

The major and minor eccentric members 24 and 26 are rigidly connected to the direct gears 62 and 64, respectively. In particular, the eccentric members 24 and 26 can be integrally formed with the direct gears 52 and 62 by milling or casting or can be bolted, welded, or otherwise attached to the direct gears 52 and 62.

FIG. 1 further shows that the first and second motor assemblies 30 and 32 comprise first and second motors 70 and 72 and first and second motor gears 74 and 76, respectively. The first and second motors 70 and 72 are connected to first and second motor gears 74 and 76 by first and second motor shafts 80 and 82, respectively.

The eccentric members 24 and 26, motor assemblies 30 and 32, and transmission system 34 are all supported by a housing assembly 84. The housing assembly 84 comprises a housing structure 86 and a plurality of housing bearing assemblies 88. The housing bearing assemblies 88 rotatably support shafts 90 and 92. The bearing assemblies 88 allow the shafts 90 and 92 to rotate relative to the housing structure 86.

The pin gears 50 and 60 are rotatably supported on the shafts 90 and 92 by ring bearing assemblies 94. The example direct gears 52 and 62 are secured to the shafts 90 and 92. The axes $A_{JPa}$ and $A_{NDa}$ are aligned with the shaft 90*a*, the axes $A_{JDa}$ and $A_{Npa}$ are aligned with the shaft 92*a*, the axes $A_{JDb}$ and $A_{NPb}$ are aligned with the shaft 92*b*, and the axes $A_{JPb}$ and $A_{NDb}$ are aligned with the shaft 90*b*.

While FIG. 1 is highly schematic, FIGS. 2 and 3 show the physical structure of the example eccentric vibratory device 22. In particular, the first and second transverse axes $A_{T1}$ and $A_{T2}$ associated with the first and second transmission assemblies 40 and 42 are parallel and spaced an equal distance from the main transverse axis $A_{TM}$. The axes $A_{JD}$ and $A_{NP}$ are substantially collinear, and the axes $A_{JP}$ and $A_{ND}$ are also substantially collinear.

The drive pins 54 and 64 extend from the pin gears 50 and 60 towards the main transverse axis $A_{TM}$ and in a direction that is substantially parallel to the axes $A_{JP}$ and $A_{NP}$ associated with the pin gears 50 and 60. The eccentric members 24 and 26 extend from the direct gears 52 and 62 towards the pin gear 50 or 60 corresponding thereto. The centers of gravity of the eccentric members 24 and 26 substantially lie along the main transverse axis $A_{TM}$.

The pin gears 50 and 60 and the direct gears 52 and 62 corresponding thereto define eccentric regions 96 and 98 in which the eccentric members 24 and 26, respectively, rotate. The eccentric members 24 and 26 occupy approximately one half of the eccentric regions 96 and 98. The drive pins 54 and 64 extend into portions of the eccentric regions 96 and 98, respectively, which are not occupied by the eccentric members 24 and 26.

Accordingly, as shown in FIG. 2, the drive pins 54 and 64 overlap the eccentric members 24 and 26 in a transverse plane. Rotation of the gears 50, 52, 60, and 62 thus causes the eccentric members 24 and 26 and the drive pins 54 and 64, respectively, to engage each other. To facilitate engagement of the drive pins 54 and 64 with the eccentric members 24 and 26, optional first and second pin pockets 100 and 102 may be formed on each of the eccentric members 24 and 26. Optional pin covers 104 may be formed on the drive pins 54 and 64 to reduce wear.

As will be discussed in further detail below with reference to FIGS. 4–6, the relative rotational speeds of the gears 50, 52, 60, and 62 determines whether the eccentric members 24 and 26 drive their associated drive pin 54 or 64 or whether the drive pins 54 and 56 drive their associated eccentric member 24 or 26.

Given that the example eccentric vibration device 22 comprises two major eccentric members 24*a* and 24*b* and two minor eccentric members 26*a* and 26*b*, the transmission system 34 further includes first and second major pin gears 50*a* and 50*b*, first and second major direct gears 52*a* and 52*b*, first and second major drive pins 54*a* and 54*b*, first and second minor pin gears 60*a* and 60*b*, first and second minor direct gears 62*a* and 62*b*, and first and second minor drive pins 54*a* and 54*b*.

As shown in FIGS. 1 and 2, the first transmission assembly 40 comprises a gear sequence comprising the first major pin gear 50*a*, the first major direct gear 52*a*, the second major direct gear 52*b*, and the second major pin gear 50*b*. The second transmission assembly 42 comprises a gear sequence comprising the first minor direct gear 62*a*, the first minor pin gear 60*a*, the second minor pin gear 60*b*, and the second minor direct gear 62*b*. Each gear in the gear sequences formed by the example first and second transmission assemblies 40 and 42 engages the adjacent gear or gears in a conventional manner. In the example transmission system 34, the first motor gear 74 engages the first major pin gear 50*a*, while the second motor gear 76 engages and rotates the second minor direct gear 62*b*.

Accordingly, the operation of the first and second motors 70 and 72 causes rotation of the gears 50*a,b* and 52*a,b* and 60*a,b* and 62*a,b* in each of the gear sequences formed by the first and second transmission assemblies 40 and 42.

In addition, the drive pins 54*a,b* and 64*a,b* interconnect the two transmission assemblies 40 and 42 as will now be described in further detail with reference to FIGS. 4–6. The section views of FIGS. 4–6 do not show the minor pin and drive gears 60*a,b* and 62*a,b*, but these views do illustrate the minor eccentrics 26*a,b* and minor drive pins 64*a,b* extending from these minor gears 60*a,b* and 62*a,b*. FIGS. 4–6 thus illustrate the relative positions of the major components of the transmission assemblies 40 and 42 during the first and second modes.

Figure 4:
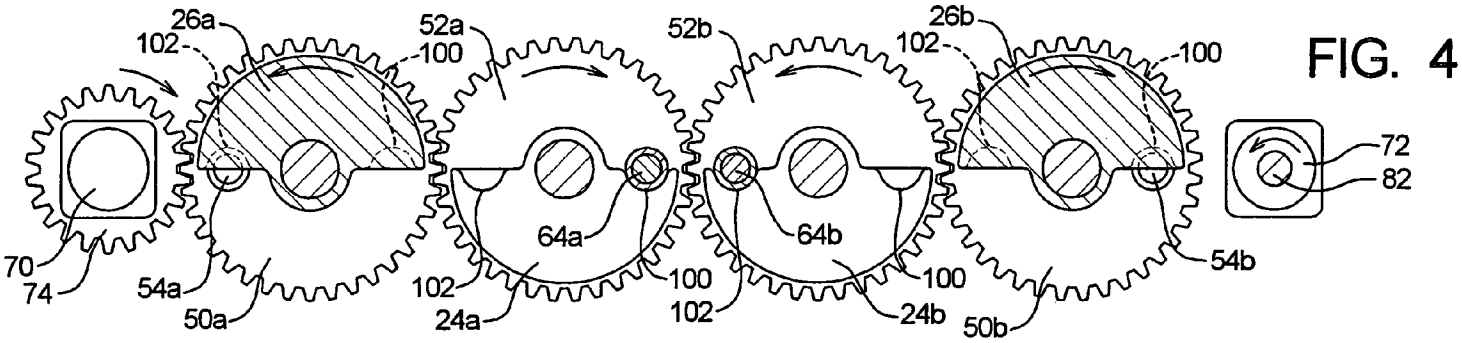
FIG. 4 is a section view taken along lines 4—4 in FIG. 2, depicting a transmission system of the vibratory device of FIG. 2 in a first mode.
Figure 5:
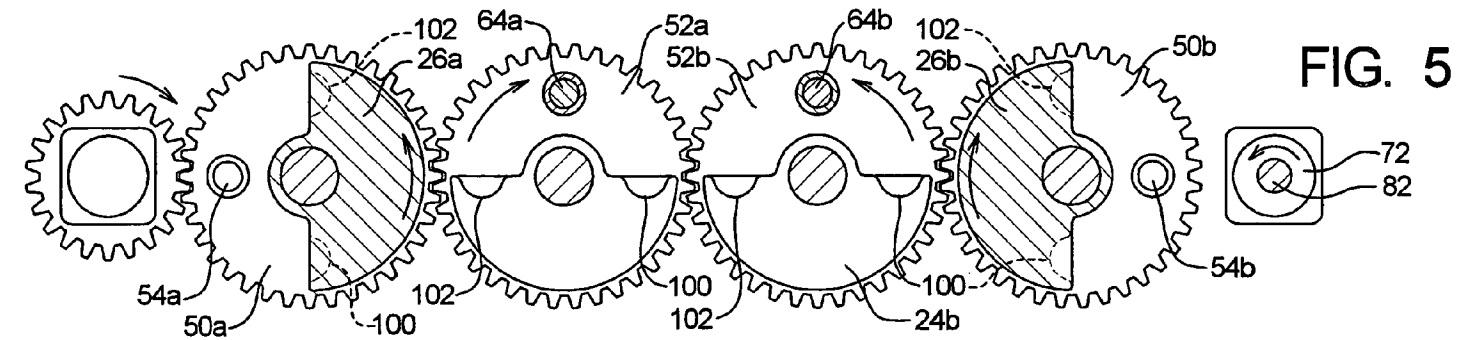
FIG. 5 is a section view from the same perspective as FIG. 4 depicting the transmission system in a third mode.
Figure 6:
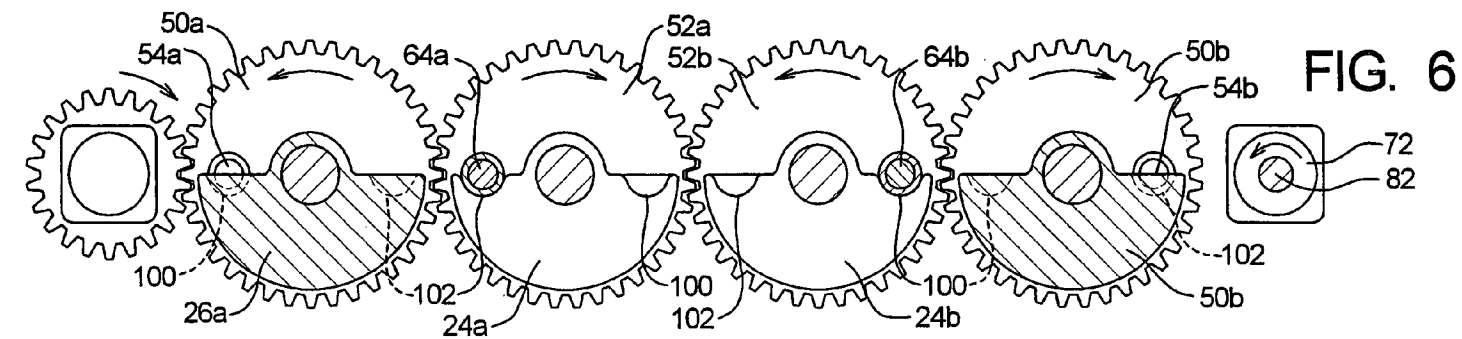
FIG. 6 is a section view from the same perspective as FIG. 4 depicting the transmission system in a second mode.

The operation of the transmission system 34 in its first mode is represented in FIG. 4, while the operation of the transmission system 34 in its second mode is represented in FIG. 6. The operation of the transmission system 34 in a third, or intermediate, mode is represented in FIG. 5.

As generally described above, when the system 20 is initially activated, the first and second motors 70 and 72 are both operated, but the second motor 72 is operated at a higher torque than the first motor 72. The minor gears 60*a,b* and 62*a,b* of the second transmission assembly 42 will thus initially rotate at a higher speed than the major gears 50*a,b* and 52*a,b* of the first transmission assembly 40.

The minor eccentric members 26*a,b* will thus initially rotate until the major drive pin 54*a* is received by the second pin pocket 102 of the first minor eccentric member 26*a* and the major drive pin 54*b* is received by the first pin pocket 100 of the second minor eccentric member 26*b*. Similarly, the minor drive pins 64*a,b* will initially rotate until the first minor drive pin 64*a* is received by the first pin pocket 100 of the first major eccentric member 24*a* and second the minor drive pin 64*b* is received by the second pin pocket 102 of the second major eccentric member 24*b*.

Accordingly, as shown in FIG. 4 and generally described above, when the transmission system 34 operates in the first mode, the major eccentric members 24*a,b* are counter-rotated in-phase with each other and the minor eccentric members 26*a,b* are counter-rotated in phase with each other. However, the major eccentric members 24*a,b* are 180 degrees out of phase with the minor eccentric members 26*a,b*. Accordingly, both lateral and longitudinal forces generated by the rotating eccentric members 24*a,b* and 26*a,b* are substantially cancelled.

Continued operation of the motors 70 and 72 increases the rotational speed of the eccentric members 24*a,b* and 26*a,b*. But because the lateral and longitudinal forces are cancelled, the eccentric vibration device 22 does not vibrate. The eccentric vibration device 22 thus is unlikely to cause resonant vibration of any components attached thereto when the transmission system 34 operates in the first mode.

After the rotational speed of the eccentric members 24*a,b* and 26*a,b* reaches the desired operating speed, the operating conditions of at least one of the first and second motors 70 and 72 is altered such that the torque of the first motor 70 exceeds the torque of the second motor 72. The transmission assembly 34 then enters the third or intermediate mode as shown in FIG. 5 at this point.

Because the torque of the first motor 70 now exceeds the torque of the second motor 72, the rotational speed of the major gears 50*a,b* and 52*a,b* exceeds the rotational speed of the minor gears 60*a,b* and 62*a,b* during the intermediate mode. Accordingly, as shown in FIG. 5, the major eccentrics 24*a,b* are displaced relative to the minor pins 64*a,b* and the major pins 54*a,b* are displaced relative to the minor eccentrics 26*a,b*. The eccentrics 24*a,b* and 26*a,b* continue to rotate at or near the desired operating speed while the transmission assembly 34 is in the third mode. Depending at the manner in which the torque differential is altered, the third mode can last from a part of a revolution to a plurality of revolutions of the eccentrics 24*a,b* and 26*a,c*.

Referring again now to FIG. 1, that figure further illustrates an example hydraulic system 120 that may be used to provide power to and control the operation of the vibration device 22. The hydraulic system 120 comprises a reservoir 122, an engine 124, and a pump 126 that form a supply of pressurized fluid. The pump 126 is connected to inputs 130 and 132 of the first and second motors 70 and 72, respectively. Outputs 134 and 136 of the motors 70 and 72 are connected to the reservoir 122. A check valve 150 is connected between the output of the pump 126 and the output of the flow restrictor 140.

The output 134 of the first motor 70 is indirectly connected to the reservoir 122 through a flow restrictor 140. The output 136 of the second motor 72 is directly connected to the reservoir 122. A control valve 142 is configured to place the flow restrictor 140 in a first configuration or in a second configuration. In the first configuration, the flow restrictor 140 restricts the flow of fluid through the first motor 70. In the second configuration, the flow restrictor 140 does not restrict the flow of fluid through the first motor 70.

In the example hydraulic system 120, the first motor 70 is sized such that the torque of the first motor 70 is greater than the torque of the second motor 72 at an equivalent flow rate of hydraulic fluid. The flow restrictor 140 is sized and dimensioned such that, in its first configuration, the torque of the first motor 70 is reduced to a level below the torque of the second motor 72. The transmission system 34 is thus placed in the first mode when the flow restrictor 140 is in its first configuration. When the flow restrictor 140 is in the second configuration, the torque of the first motor 70 is greater than that of the second motor 72 and the transmission system 34 is placed in the second mode.

The hydraulic system 120 is advantageous in that a single engine 124 and pump 126 may be used with simple hydraulic parts to operate the eccentric vibration device 22 as described above. Hydraulic systems such as the hydraulic system 120 have further proven to be reliable when used with eccentric vibration systems. However, other hydraulic systems and other power and control systems such as electric or pneumatic may be used to operate the vibration device 22 of the present invention.

Figure 7:
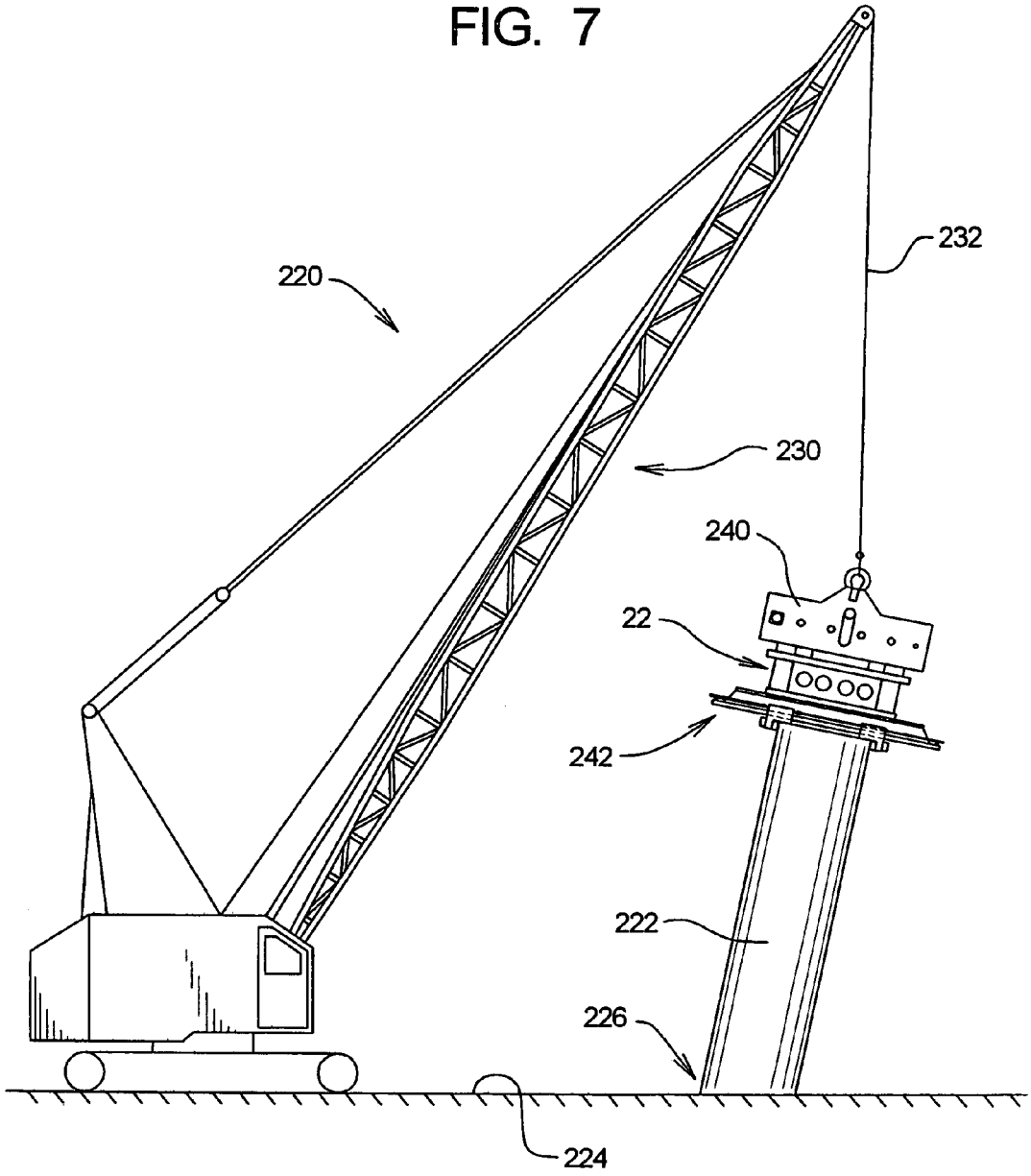
FIG. 7 is a somewhat schematic elevation view depicting the use of the vibratory device of FIG. 2 as part of a driving system.

Referring now to FIG. 7, depicted therein is a driving system 220 for driving an elongate member 222 into the ground 224 at a desired location 226. The elongate member 222 may be any member adapted to be driven into the ground but is usually a wood, metal, or concrete pile or a caisson as depicted in FIG. 7.

The driving system 220 comprises a support structure 230 and a support cable 232 suspended from the support structure 230. The example support structure 230 is depicted as a crane, but other support structures may be used.

The driving system 220 further comprises a suppressor system 240 and a clamping system 242. The suppressor system 240 is rigidly connected to the support cable 232 and the vibratory device 22 and inhibits transmission of vibratory forces to the support structure 230 through the support cable 232. The clamping system 242 rigidly connected to the vibratory device 22 and the elongate member 222 such that vibratory forces are transmitted to the member 222. The reservoir 122, engine 124, pump 126, flow restrictor 140, control valve 142, and check valve 150 are typically remotely located from the vibratory device 22 in what is commonly referred to as a power pack (not shown in FIG. 7).

As shown in FIG. 7, the vibratory device 22 is operated as described above to drive the elongate member 22 into the ground at a slight batter. However, the exact manner in which the vibratory device 22 is configured will depend upon such factors as the nature of the elongate member 222, the ground 224, and intended use of the member 222 after it has been driven into the ground 224.

Given the foregoing, the present invention may be embodied in forms other than those shown and described herein. The scope of the present invention should thus be determined by the claims appended hereto and not the foregoing detailed description of the invention.

I claim:

1. An eccentric vibration system comprising:

at least one major eccentric member;

at least one minor eccentric member;

a first motor assembly;

a second motor assembly; and a transmission system for connecting the first and second motor assemblies to the major and minor eccentric members, where the transmission system comprises at least one direct gear;

at least one pin gear; and at least one drive pin extending from the pin gear; whereby the transmission system operates in a first mode when a torque of the first motor assembly is less than a torque of the second motor assembly, and a second mode when the torque of the first motor assembly is greater than the torque of the second motor assembly;

when the transmission system operates in the first and second modes, the first and second motor assemblies rotate the major and minor eccentric members through the at least one direct gear, at least one pin gear, and at least one drive pin such that transverse vibratory forces generated by the major eccentric member substantially cancel transverse vibratory forces generated by the minor eccentric member;

when the transmission system operates in the first mode, the first and second motor assemblies rotate the major and minor eccentric members through the at least one direct gear, at least one pin gear, and at least one drive pin such that longitudinal vibratory forces generated by the major eccentric member substantially cancel longitudinal vibratory forces generated by the minor eccentric member; and when the transmission system operates in the second mode, the first and second motor assemblies rotate the major and minor eccentric members through the at least one direct gear, at least one pin gear, and at least one drive pin such that longitudinal vibratory forces generated by the major eccentric member are added to longitudinal vibratory forces generated by the minor eccentric member.

2. An eccentric vibration system as recited in claim 1, comprising a plurality of major eccentric members and a plurality of minor eccentric members, where:

the first and second motor assemblies counter-rotate the major eccentric members through the transmission system such that transverse vibratory forces generated by the major eccentric members are substantially cancelled in both the first and second modes; and the first and second motor assemblies counter-rotate the minor eccentric members through the transmission system such that transverse vibratory forces generated by the major eccentric members are substantially cancelled in both the first and second modes.

3. An eccentric vibration system as recited in claim 1, further comprising a control assembly for controlling the torque of at least one of the first and second motor assemblies to place the transmission system in a selected one of the first and second modes.

4. An eccentric vibration system as recited in claim 1, further comprising a power supply for supplying power to the first and second motor assemblies.

5. An eccentric vibration system as recited in claim 4, further comprising a control assembly for controlling the amount of power applied to at least one of the first and second motor assemblies to place the transmission system in a selected one of the first and second modes.

6. An eccentric vibration system as recited in claim 5, in which:

the first and second motor assemblies are hydraulic motor assemblies;

the power supply is a source of hydraulic fluid connected to the first and second hydraulic motor assemblies; and the control assembly is a control valve that restricts the flow of hydraulic fluid through the first hydraulic motor assembly.

7. An eccentric vibration system as recited in claim 6, in which a first rated torque associated with the first motor assembly is greater than a second rated torque associated with the second motor assembly.

8. An eccentric vibration system as recited in claim 1, in which the transmission system comprises:

a first transmission assembly comprising a major direct gear, where the major direct gear is rigidly connected to the major eccentric member, and operatively connected to the first motor assembly such that operation of the first motor assembly causes rotation of the major direct gear, a major pin gear, where the major pin gear is operatively connected to the major direct gear such that rotation of the major direct gear causes rotation of the major pin gear, and a major drive pin extending from the major pin gear to engage the minor eccentric member; and a second transmission assembly comprising a minor direct gear, where the minor direct gear is rigidly connected to the minor eccentric member, and operatively connected to the second motor assembly such that operation of the second motor assembly causes rotation of the minor direct gear, a minor pin gear, where the minor pin gear is operatively connected to the minor direct gear such that rotation of the minor direct gear causes rotation of the minor pin gear, and a minor drive pin extending from the minor pin gear to engage the major eccentric member; whereby when the transmission system operates in the first mode, the minor pin gear rotates the major eccentric member through the minor drive pin, and the minor eccentric member rotates the major pin gear through the major drive pin; and when the transmission system operates in the second mode, the major eccentric member rotates the minor pin gear through the minor drive pin, and the major pin gear rotates the minor eccentric member through the major drive pin.

9. An eccentric vibration system as recited in claim 1, further comprising:

first and second major eccentric members;

first and second minor eccentric members; wherein the transmission system comprises:

a first transmission assembly comprising first and second major direct gears, where the first and major direct gears are rigidly connected to the first and second major eccentric members, respectively, and operatively connected to the first motor assembly such that operation of the first motor assembly causes rotation of the first and second major direct gears, first and second major pin gears, where the first and second major pin gears are operatively connected to the first and second major direct gears such that rotation of the major direct gears causes rotation of the major pin gears, and first and second major drive pins extending from the first and second major pin gears to engage the first and second major eccentric members, respectively; and a second transmission assembly comprising first and second minor direct gears, where the first and minor direct gears are rigidly connected to the first and second minor eccentric members, respectively, and operatively connected to the first motor assembly such that operation of the first motor assembly causes rotation of the first and second minor direct gears, first and second minor pin gears, where the first and second minor pin gears are operatively connected to the first and second minor direct gears such that rotation of the minor direct gears causes rotation of the minor pin gears, and first and second minor drive pins extending from the first and second minor pin gears to engage the first and second minor eccentric members, respectively; whereby when the transmission system operates in the first mode, the minor pin gears rotate the major eccentric members through the minor drive pins, and the minor eccentric members rotate the major pin gear through the major drive pin; and when the transmission system operates in the second mode, the major eccentric member rotates the minor pin gear through the minor drive pin, and the major pin gear rotates the minor eccentric member through the major drive pin.

10. An eccentric vibration system as recited in claim 1, in which:

the major and minor eccentric members are arranged along a transverse system axis; and the transmission system is substantially symmetrically arranged about the transverse system axis.

11. An eccentric vibration system as recited in claim 1, in which:

the major and minor eccentric members are arranged along a transverse system axis; and the transmission system comprises first and second transmission assemblies substantially symmetrically arranged on opposite sides of the transverse system axis.

12. An eccentric vibration system as recited in claim 8, in which:

the major and minor eccentric members are arranged along a transverse system axis; and the first and second transmission assemblies are substantially symmetrically arranged on opposite sides of the transverse system axis.

13. An eccentric vibration system as recited in claim 9, in which:

the major and minor eccentric members are arranged along a transverse system axis; and the first and second transmission assemblies are substantially symmetrically arranged on opposite sides of the transverse system axis.

14. An eccentric vibration system as recited in claim 13, in which:

the first motor assembly engages and rotates the first major pin gear, the first major pin gear engages and rotates the first major direct gear, the first major direct gear engages and rotates the second major direct gear, and the second major direct gear engages and rotates the second major pin gear; and the second motor assembly engages and rotates the first minor direct gear, the first minor direct gear engages and rotates the first minor pin gear, the first minor pin gear engages and rotates the second minor pin gear, and the second minor pin gear engages and rotates the second minor direct gear.

15. An eccentric vibration system comprising:

at least one major eccentric member;

at least one minor eccentric member;

a first motor assembly;

a second motor assembly; and a transmission system for connecting the first and second motor assemblies to the major and minor eccentric members, where the transmission system operates in a first mode when a torque of the first motor assembly is less than a torque of the second motor assembly, and a second mode when the torque of the first motor assembly is greater than the torque of the second motor assembly; whereby when the transmission system operates in the first and second modes, the first and second motor assemblies rotate the major and minor eccentric members through the transmission system such that transverse vibratory forces generated by the major eccentric member substantially cancel transverse vibratory forces generated by the minor eccentric member;

when the transmission system operates in the first mode, the first and second motor assemblies rotate the major and minor eccentric members through the transmission system such that longitudinal vibratory forces generated by the major eccentric member substantially cancel longitudinal vibratory forces generated by the minor eccentric member;

when the transmission system operates in the second mode, the first and second motor assemblies rotate the major and minor eccentric members through the transmission system such that longitudinal vibratory forces generated by the major eccentric member are added to longitudinal vibratory forces generated by the minor eccentric member; and the transmission system comprises:

a first transmission assembly comprising a major direct gear, where the major direct gear is rigidly connected to the major eccentric member, and operatively connected to the first motor assembly such that operation of the first motor assembly causes rotation of the major direct gear, a major pin gear, where the major pin gear is operatively connected to the major direct gear such that rotation of the major direct gear causes rotation of the major pin gear, and a major drive pin extending from the major pin gear to engage the minor eccentric member; and a second transmission assembly comprising a minor direct gear, where the minor direct gear is rigidly connected to the minor eccentric member, and operatively connected to the second motor assembly such that operation of the second motor assembly causes rotation of the minor direct gear, a minor pin gear, where the minor pin gear is operatively connected to the minor direct gear such that rotation of the minor direct gear causes rotation of the minor pin gear, and a minor drive pin extending from the minor pin gear to engage the major eccentric member; whereby when the transmission system operates in the first mode, the minor pin gear rotates the major eccentric member through the minor drive pin, and the minor eccentric member rotates the major pin gear through the major drive pin; and when the transmission system operates in the second mode, the major eccentric member rotates the minor pin gear through the minor drive pin, and the major pin gear rotates the minor eccentric member through the major drive pin.

16. An eccentric vibration system as recited in claim 15, comprising a plurality of major eccentric members and a plurality of minor eccentric members, where:

the first and second motor assemblies counter-rotate the major eccentric members through the transmission system such that transverse vibratory forces generated by the major eccentric members are substantially cancelled in both the first and second modes; and the first and second motor assemblies counter-rotate the minor eccentric members through the transmission system such that transverse vibratory forces generated by the major eccentric members are substantially cancelled in both the first and second modes.

17. An eccentric vibration system as recited in claim 15, further comprising a control assembly for controlling the torque of at least one of the first and second motor assemblies to place the transmission system in a selected one of the first and second modes.

18. An eccentric vibration system as recited in claim 15, further comprising a power supply for supplying power to the first and second motor assemblies.

19. An eccentric vibration system as recited in claim 18, further comprising a control assembly for controlling the amount of power applied to at least one of the first and second motor assemblies to place the transmission system in a selected one of the first and second modes.

20. An eccentric vibration system as recited in claim 19, in which:

the first and second motor assemblies are hydraulic motor assemblies;

the power supply is a source of hydraulic fluid connected to the first and second hydraulic motor assemblies; and the control assembly is a control valve that restricts the flow of hydraulic fluid through the first hydraulic motor assembly.

21. An eccentric vibration system as recited in claim 20, in which a first rated torque associated with the first motor assembly is greater than a second rated torque associated with the second motor assembly.

22. An eccentric vibration system as recited in claim 15, in which:

the major and minor eccentric members are arranged along a transverse system axis; and the transmission system is substantially symmetrically arranged about the transverse system axis.

23. An eccentric vibration system as recited in claim 15, in which:

the major and minor eccentric members are arranged along a transverse system axis; and the transmission system comprises first and second transmission assemblies substantially symmetrically arranged on opposite sides of the transverse system axis.

24. An eccentric vibration system as recited in claim 15, in which:

the major and minor eccentric members are arranged along a transverse system axis; and the first and second transmission assemblies are substantially symmetrically arranged on opposite sides of the transverse system axis.

25. An eccentric vibration system comprising:

first and second major eccentric members;

first and second minor eccentric member;

a first motor assembly;

a second motor assembly; and a transmission system for connecting the first and second motor assemblies to the major and minor eccentric members, where the transmission system operates in a first mode when a torque of the first motor assembly is less than a torque of the second motor assembly, and a second mode when the torque of the first motor assembly is greater than the torque of the second motor assembly; whereby when the transmission system operates in the first and second modes, the first and second motor assemblies rotate the major and minor eccentric members through the transmission system such that transverse vibratory forces generated by the major eccentric member substantially cancel transverse vibratory forces generated by the minor eccentric member;

when the transmission system operates in the first mode, the first and second motor assemblies rotate the major and minor eccentric members through the transmission system such that longitudinal vibratory forces generated by the major eccentric member substantially cancel longitudinal vibratory forces generated by the minor eccentric member;

when the transmission system operates in the second mode, the first and second motor assemblies rotate the major and minor eccentric members through the transmission system such that longitudinal vibratory forces generated by the major eccentric member are added to longitudinal vibratory forces generated by the minor eccentric member; and the transmission system comprises a first transmission assembly comprising first and second major direct gears, where the first and major direct gears are rigidly connected to the first and second major eccentric members, respectively, and operatively connected to the first motor assembly such that operation of the first motor assembly causes rotation of the first and second major direct gears, first and second major pin gears, where the first and second major pin gears are operatively connected to the first and second major direct gears such that rotation of the major direct gears causes rotation of the major pin gears, and first and second major drive pins extending from the first and second major pin gears to engage the first and second major eccentric members, respectively; and a second transmission assembly comprising first and second minor direct gears, where the first and minor direct gears are rigidly connected to the first and second minor eccentric members, respectively, and operatively connected to the first motor assembly such that operation of the first motor assembly causes rotation of the first and second minor direct gears, first and second minor pin gears, where the first and second minor pin gears are operatively connected to the first and second minor direct gears such that rotation of the minor direct gears causes rotation of the minor pin gears, and first and second minor drive pins extending from the first and second minor pin gears to engage the first and second minor eccentric members, respectively; whereby when the transmission system operates in the first mode, the minor pin gears rotate the major eccentric members through the minor drive pins, and the minor eccentric members rotate the major pin gear through the major drive pin; and when the transmission system operates in the second mode, the major eccentric member rotates the minor pin gear through the minor drive pin, and the major pin gear rotates the minor eccentric member through the major drive pin.

26. An eccentric vibration system as recited in claim 25, in which:

the first and second motor assemblies counter-rotate the major eccentric members through the transmission system such that transverse vibratory forces generated by the major eccentric members are substantially cancelled in both the first and second modes; and the first and second motor assemblies counter-rotate the minor eccentric members through the transmission system such that transverse vibratory forces generated by the major eccentric members are substantially cancelled in both the first and second modes.

27. An eccentric vibration system as recited in claim 25, further comprising a control assembly for controlling the torque of at least one of the first and second motor assemblies to place the transmission system in a selected one of the first and second modes.

28. An eccentric vibration system as recited in claim 25, further comprising a power supply for supplying power to the first and second motor assemblies.

29. An eccentric vibration system as recited in claim 28, further comprising a control assembly for controlling the amount of power applied to at least one of the first and second motor assemblies to place the transmission system in a selected one of the first and second modes.

30. An eccentric vibration system as recited in claim 29, in which:

the first and second motor assemblies are hydraulic motor assemblies;

the power supply is a source of hydraulic fluid connected to the first and second hydraulic motor assemblies; and the control assembly is a control valve that restricts the flow of hydraulic fluid through the first hydraulic motor assembly.

31. An eccentric vibration system as recited in claim 30, in which a first rated torque associated with the first motor assembly is greater than a second rated torque associated with the second motor assembly.

32. An eccentric vibration system as recited in claim 25, in which:

the major and minor eccentric members are arranged along a transverse system axis; and the transmission system is substantially symmetrically arranged about the transverse system axis.

33. An eccentric vibration system as recited in claim 25, in which:

the major and minor eccentric members are arranged along a transverse system axis; and the transmission system comprises first and second transmission assemblies substantially symmetrically arranged on opposite sides of the transverse system axis.

34. An eccentric vibration system as recited in claim 25, in which:

the major and minor eccentric members are arranged along a transverse system axis; and the first and second transmission assemblies are substantially symmetrically arranged on opposite sides of the transverse system axis.

35. An eccentric vibration system as recited in claim 34, in which:

the first motor assembly engages and rotates the first major pin gear, the first major pin gear engages and rotates the first major direct gear, the first major direct gear engages and rotates the second major direct gear, and the second major direct gear engages and rotates the second major pin gear; and the second motor assembly engages and rotates the first minor direct gear, the first minor direct gear engages and rotates the first minor pin gear, the first minor pin gear engages and rotates the second minor pin gear, and the second minor pin gear engages and rotates the second minor direct gear.

* * * * *